US007325292B2

(12) United States Patent
Minor

(10) Patent No.: US 7,325,292 B2
(45) Date of Patent: Feb. 5, 2008

(54) METHOD FOR REFINISHING A TEST ELECTRODE

(75) Inventor: Lara J. Minor, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 426 days.

(21) Appl. No.: 11/006,299

(22) Filed: Dec. 6, 2004

(65) Prior Publication Data

US 2006/0121836 A1 Jun. 8, 2006

(51) Int. Cl.
*G01R 31/28* (2006.01)

(52) U.S. Cl. ..... 29/593; 29/739; 29/760; 29/761; 204/280; 451/51

(58) Field of Classification Search ..... 29/592.1, 29/593, 739, 760, 761; 204/280; 451/51
See application file for complete search history.

(56) References Cited

U.S. PATENT DOCUMENTS 3,750,250 A * 8/1973 Brown ..... 29/895.21
3,772,178 A * 11/1973 Wilson ..... 204/404

FOREIGN PATENT DOCUMENTS

JP 08084640 A * 4/1996

* cited by examiner

*Primary Examiner*—Paul D. Kim
(74) *Attorney, Agent, or Firm*—Mark E. Duell, Esq.; Porter Wright Morris & Arthur LLP

(57) ABSTRACT

A method for reusing a conductive (carbon) core/glass or sapphire cylinder test electrode comprising expelling spent core material from the tip of the electrode and refinishing the electrode tip for use in further tests and refinished test electrodes produced in accordance with the method.

6 Claims, 3 Drawing Sheets

METHOD FOR REFINISHING A TEST ELECTRODE

FIELD OF THE INVENTION

The present invention relates to a tool and method for refinishing for reuse test electrodes, particularly disk electrodes used in an evaluation process to determine the suitability of materials for predetermined applications.

BACKGROUND OF THE INVENTION

In the evaluation process to determine the suitability of materials for specified applications (such as for catalyst or reactor applications), predetermined material compositions are deposited on a testing substrate. In a typical evaluation process using electrodes to test selected material compositions for possible catalyst and other uses, a cylindrical sapphire (or other glass) surrounding a carbon core electrode is mounted in a holder, the test material under consideration is applied to or coated upon the tip of the sapphire or glass/carbon electrode, and the test is conducted. See, for example, United States Application for Patent Serial Number Ser. No. 10/757,302 filed Jan. 14, 2004 for "High Throughput Physical Vapor Deposition System for Material Combinatorial Studies" and United States Application for Patent Serial Number Ser. No. 10/800,553, filed Mar. 15, 2004 for "Holder for Sample Materials Used in High Throughput Physical Vapor Deposition Material Studies" commonly owned by the assignee of the present application. After a test, the test material on the tip surface is polished away and the carbon/sapphire electrode can be recoated with a next material for another test. When the electrode is so spent that reuse by polishing and coating is not possible, considerable expense is incurred in replacing each sapphire/carbon electrode assembly when numerous, for example, hundreds or thousands or more, test materials are evaluated. There exists a need to provide a system or device whereby expensive test electrodes can be reconfigured for reuse; thereby avoiding the expense of replacement.

In the prior art, no suitable means of recycling carbon core/sapphire electrodes has been found. U.S. Pat. No. 6,685,539 to Enomoto et al., discloses a processing tool to carry out a fixed-abrasive grinding process on a surface of a silicon work-piece. The processing tool includes abrasive grains made up of silica grains to provide a ground-up surface. U.S. Pat. No. 5,983,434 to Eichinger et al., discloses a rotary bristle tool for polishing or cleaning a substrate. Neither patent, however, provides an effective manner of refinishing the electrodes, when their conventional life is exhausted, as set out in this application.

BRIEF SUMMARY OF THE INVENTION

It is an object of the present invention to provide a tool and method that allows the convenient refinishing of a carbon core/glass or sapphire cylinder substrate, particularly useful with electrode materials, and to reduce the costs involved in the testing and evaluation of numerous materials.

The invention is described more fully in the following description of the preferred embodiment considered in view of the drawings in which:

DETAILED DESCRIPTION OF THE INVENTION

The present invention provides a tool and method that allows the convenient refinishing for reuse of a glass or sapphire cylinder/carbon or other conductor core electrode and comprises a tool is used to expel small increments of coating material or carbon material, with a high degree of precision from the end of the electrode. After the coating or carbon material is expelled, the electrode tip is polished until the sapphire and carbon surface is smooth again, allowing a further test material to be deposited thereon. The invention advantageously allows the use and reuse of a sapphire cylinder carbon core electrode multiple times, beyond that achieved by conventional practice of removing the test material by polishing, without need for destruction or replacement. A high level of accuracy associated with the tool accuracy enables the invention to expel very small amounts of carbon or test material with good efficiency, allowing a tip to be used many times.

In the invention, pitted or unusable material that renders the sapphire cylinder carbon core electrode incapable of conventional refinishing by polishing alone is expelled from a sapphire cylinder carbon core electrode. The electrode is refinished. Using a tool, the electrode tip is refinished in a method by positioning the electrode in the holder in a tool wherein the electrode and a means within the tool are concentrically aligned along a longitudinal axis in a relationship in which the spent end of the carbon element is disposed toward a receptacle fixed in place in the tool; the opposite end of the electrode is disposed in contact with a longitudinally moveable end of the tool; and the holder for the electrode is maintained in a fixed relationship with respect to the receptacle in the tool. The moveable end of the tool is incrementally extended with respect to the electrode such that the carbon core of the electrode is incrementally expelled from the holder a longitudinal distance corresponding to the extent of the spent or unusable material at the tip end of the electrode. The electrode within the holder is removed from the tool. The electrode tip is smoothed, polished and finished until the carbon element is smooth with respect to the surface of the sapphire holder. The formerly unusable test electrode with a tip surface so refinished is then capable of reuse.

Figure 1:
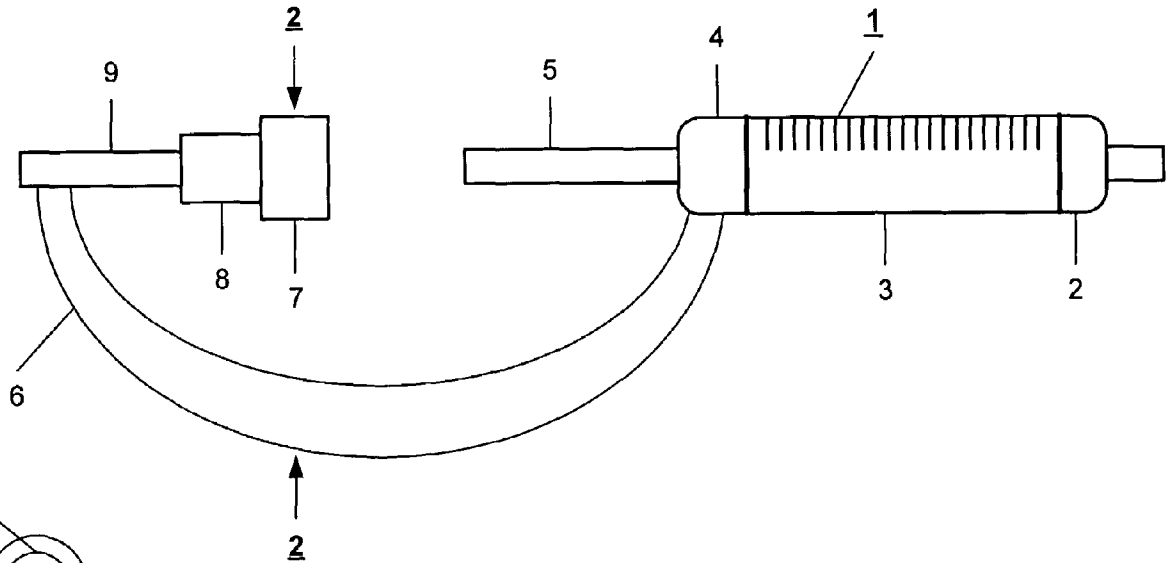
FIG. 1 is a side view of the expeller tool used in the invention.
Figure 2:
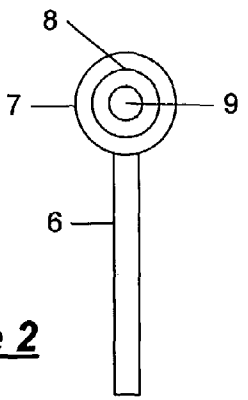
FIG. 2 shows a cross-section of the upper portion of the tool through section 2→←2 shown in FIG. 1

In the side view of an example of the tool as shown in FIG. 1, the tool 1 essentially comprises a vice or micrometer like device having a base with ends 2 and 4 supporting a barrel 3 that rotates around shaft 5 in increments determined by corresponding external and internal threads formed in the shaft 5 and barrel 3. A ratchet or equivalent means for effecting incremental or longitudinal movement may similarly be employed. As the barrel is rotated, the shaft extends or retracts from a predetermined longitudinal location with respect to the length of the tool. Support 6 extends from base end 4 terminating at a length where coaxially aligned shaft 9 longitudinally extends in a matching relationship with shaft 5. Coaxially mounted on shaft 9 is a holder assembly comprising receptacle 7 and support 8 for the carbon/sapphire/holder assembly to be processed. As shown in cross section in FIG. 5A and FIG. 5B, receptacle 7 includes a concentric seat for the tip holder and a recess allowing a longitudinal tolerance for the tip material expelled from the holder. FIG. 2 shows a cross-section of the upper portion of the tool through section 2→←2 shown in FIG. 1 with common elements indicated by the same reference numbers.

Figure 3A:
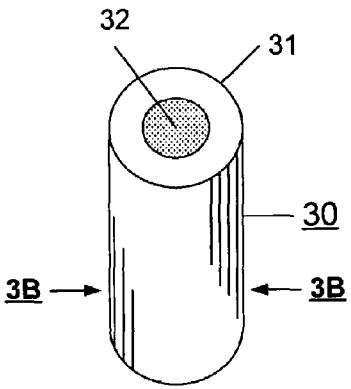
FIG. 3A and FIG. 3B respectively are perspective and cross section 3B→←3B views of a sapphire cylinder carbon core electrode.
Figure 3B:
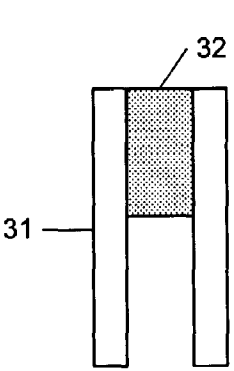
Figure 3C:
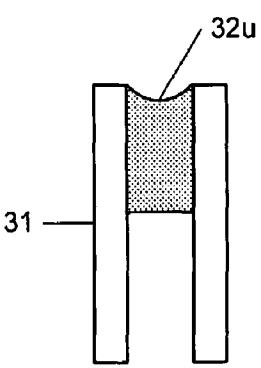
FIG. 3C depicts a pitted crater in the carbon element of the electrode shown in FIG. 3A and FIG. 3B, rendering the electrode unuseable.

FIG. 3A and FIG. 3B respectively are perspective and cross section views of a carbon/sapphire tip coaxially maintained in a cylindrical holder 30. The carbon core is indicated at 32 enclosed on its sides within sapphire cylinder 31. The cross section through section 3B→←3B of FIG. 3A is shown in FIG. 3B where the upper end of the carbon core and glass holder are essentially in a smooth planar alignment suitable for the deposit or coating of a test material. FIG. 3C depicts a pitted crater 32u in the carbon element test end of the electrode shown in FIG. 3A and FIG. 3B. (The drawing figure is not to a real scale and the pitting or erosion is exaggerated for purposes of clarity in explaining the invention.) In conventional practice, the pitting or erosion 32u at the surface renders the electrode unuseable.

Figure 4A:
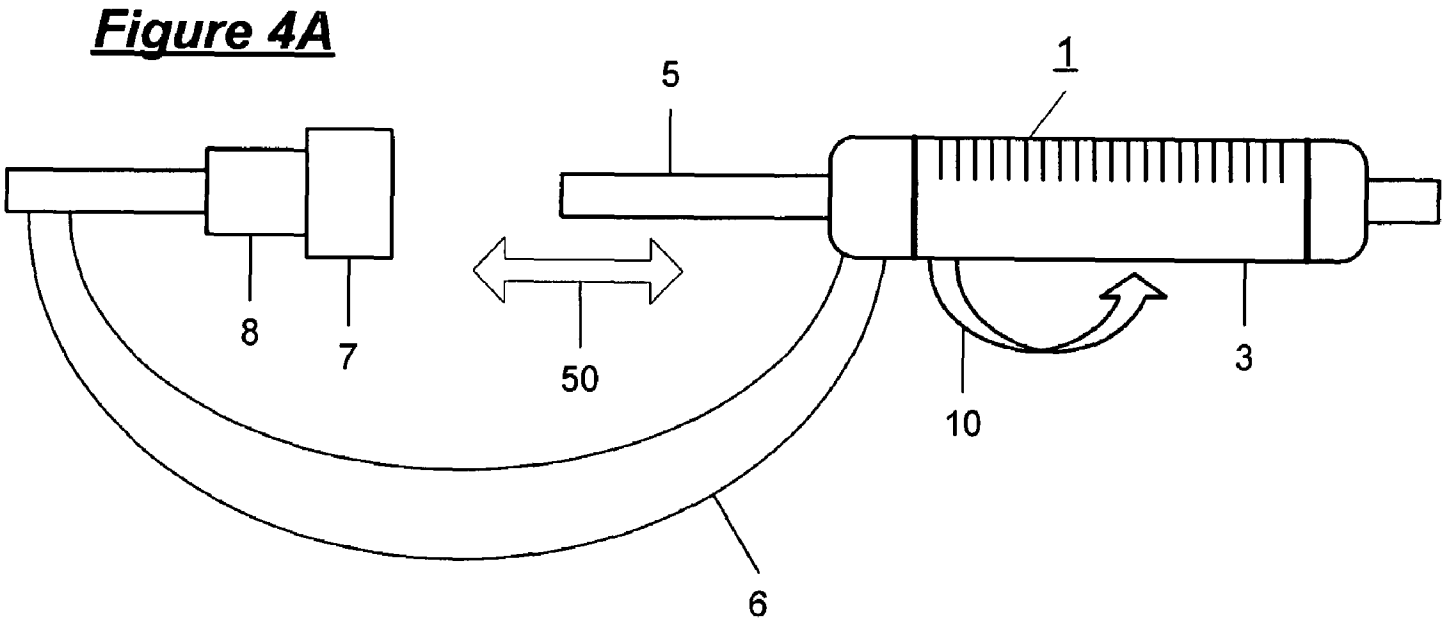
FIG. 4A and FIG. 4B show the tool in operation expelling material from the sapphire cylinder carbon core electrode.
Figure 4B:
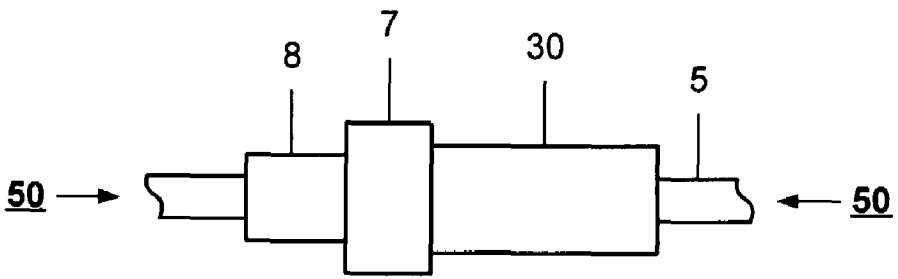
Figure 5C:
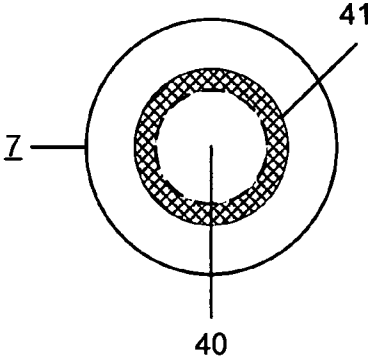
FIG. 5C is a transverse cross section view of the receptacle through section 5C→←5C of FIG. 5A.
Figure 5A:
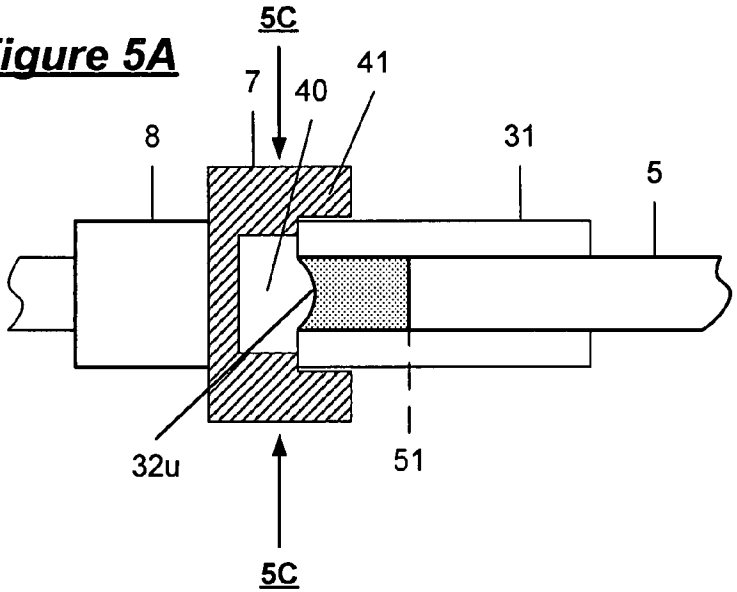
FIG. 5A and FIG. 5B are enlarged cross section views through section 50→←50 of FIG. 4B showing elements of the tool while in operation.
Figure 6B:
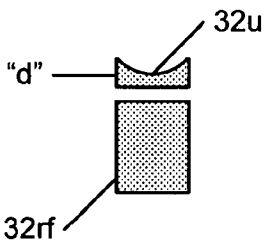
FIG. 6A shows a cross section of an electrode refinished in accordance with the invention and FIG. 6B shows the expelled segment removed from the electrode leaving a segment that is smoothed and polished away for reuse to a degree sufficient to match the surface of the glass cylinder.
Figure 6A:
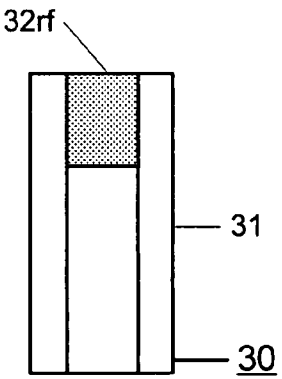
Figure 5B:
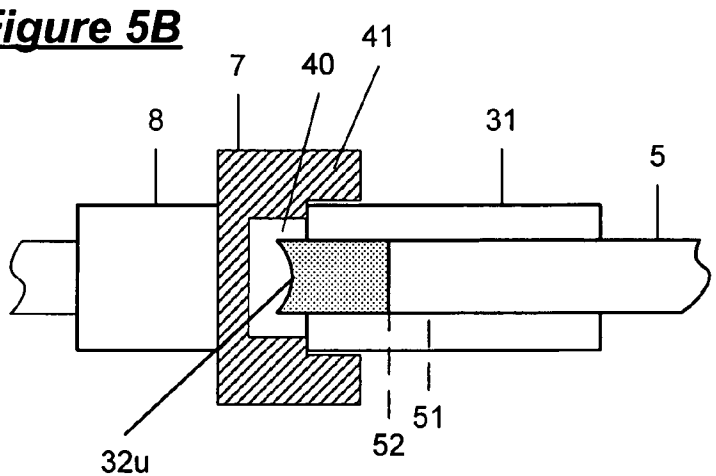

The operation of the tool in expelling material from the electrode tip after a test is explained with reference to FIG. 4A and FIG. 4B and FIG. 5A and FIG. 5B. As shown by the reference arrows 10 and 11 with respect to the tool 1 depicted in FIG. 4A, rotation of the handle 3 results in longitudinal movement of the shaft 5 along the axis of the coaxial shafts 5 and 9. In FIG. 4B, the electrode assembly 30 is seated in female receiver 7. In the cross sections of FIG. 5A and 5B, when the specimen 30 is placed into position between shaft 5 and female relief shape 7, the handle 3 is then rotated 10 which causes shaft 5 to extend a distance "d" from longitudinal location 51 to longitudinal location 52, and carbon material 32*u* to be expelled from sapphire cylinder 31 of the electrode 30 a distance corresponding to "d." Distance "d" preferably is only to the extent of the existing surface deformity such that the concentric sapphire carbon assembly. (For purposes of clarity, the relative distance between location 51 and location 52, "d," is exaggerated in the drawing figure, although incremental segments expelled may be made, for example, in lengths of 0.005 mm using a suitable micrometer movement.) In the longitudinal cross section detail shown in FIG. 5A and FIG. 5B, receptacle 7 includes a concentric seat 50 for the electrode 30 and a narrower recess 40 allowing a longitudinal tolerance for the spent material 32*u* expelled from the holder. The transverse cross section of the receptacle 7 shown in FIG. 5C shows the coaxial alignment of the seat 41 and recess 40 in the receptacle 7. FIG. 6A shows a cross section of an electrode 30 refinished in accordance with the invention. The carbon segment 32*rf* remaining in the sapphire cylinder 31 after the expelled segment "d" (or 32*u*) as shown in FIG. 6B is smoothed or ground away and polished by known means to a degree sufficient to match 32*f* the surface of the glass cylinder 31. In certain instances, the a segment of the corresponding end surface of the cylinder holding the core may be ground away in the refinishing process to achieve a planar concentric surface for the electrode. A refinished electrode capable of many more reuses is thereby achieved which may be coated with test materials such as metals, oxides, catalysts and the like for evaluation. Specific dimensions for the diameters of the receptacle, seat and recess, and expelling increments, are essentially determined by the corresponding sizes of the tip and holder processed and the degree of surface deformation or pitting encountered.

Thus, firmly embedded core material is expelled from the end of a hard glass cylinder. Using a finely threaded micrometer base movement, expulsion length control is within 0.5 mm or any other desired length determined by the corresponding threads of the shaft 5 and barrel 3.

Having described the invention in detail, those skilled in the art will appreciate that, given the present description, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims.

The invention claimed is:

1. A method for refinishing a test electrode coaxially maintained in a cylinder comprising expelling conductive core material from the cylinder and refinishing the tip of the electrode in accordance with the sequence of (1) positioning the cylinder containing the electrode in a holder in a tool wherein the electrode to be reused and a means within the tool are concentrically aligned along a longitudinal axis in a relationship in which (a) the used end of the electrode is disposed toward a receptacle fixed in place in the tool and the opposite end of the electrode is disposed such that the core is in contact with a longitudinally moveable means of the tool, and (b) the cylinder coaxially surrounding the core of the electrode is maintained in a fixed relationship with respect to the receptacle in the tool; (2) incrementally extending the moveable end of the tool with respect to the core such that a segment of the core is incrementally expelled from the cylinder a longitudinal distance corresponding to the longitudinal movement of the tool; (3) removing the electrode from the tool; and (4) refinishing the electrode by removing material from the core expelled until the core in the electrode is smooth with respect to the end surface of the cylinder coaxially surrounding the core.

2. The method of claim 1 wherein refinishing the electrode tip includes polishing the core material and the cylinder such that the ends of the surfaces of the core material and the cylinder are each in the same plane.

3. The method of claim 1 wherein a segment of the cylinder surrounding the core is ground away in the refinishing process to achieve a planar concentric end surface for the electrode assembly.

4. The method of claim 1 wherein a segment of the cylinder surrounding the core is ground away in the refinishing process to achieve a planar concentric end surface for the coaxial assembly of the core and the cylinder.

5. The method of claim 1 wherein the step of incrementally extending the moveable end of the tool with respect to the core such that a segment of the core is incrementally expelled from the cylinder comprises rotating a barrel that rotates around a concentric shaft in increments determined by corresponding internal and external threads formed within the barrel and on the shaft.

6. The method of claim 1 wherein the step of incrementally extending the moveable end of the tool with respect to the core such that a segment of the core is incrementally expelled from the cylinder comprises incrementally advancing the core along a ratchet.

* * * * *